United States Patent [19]

Minerd

[11] 4,341,143

[45] Jul. 27, 1982

[54] REMOTE-CONTROLLED KEY-DEPRESSING DEVICE

[76] Inventor: Russell C. Minerd, P.O. Box 554, Scarsdale, N.Y. 10583

[21] Appl. No.: 161,300

[22] Filed: Jun. 20, 1980

[51] Int. Cl.[3] ..... G10F 3/00

[52] U.S. Cl. ..... 84/107; 84/115

[58] Field of Search ..... 84/105–107, 84/1.01, 113, 115

[56] References Cited

U.S. PATENT DOCUMENTS 150,429 5/1874 Perry ..... 84/106

4,206,677 6/1980 Ramsey ..... 84/107

*Primary Examiner*—Gene Z. Rubinson

*Assistant Examiner*—Forester W. Isen

*Attorney, Agent, or Firm*—Kenneth E. Macklin

[57] ABSTRACT

A remote-controlled device for depressing the keys of a keyboard instrument which comprises in the device: separate means for depressing each of the desired keys, each of said means being pivotally mounted on a fulcrum, means for selectively rotating the key-depressing means about its fulcrum so that at least a part of each of the corresponding key-depressing means depresses the desired keys of the instrument's keyboard, above which the device is positioned.

This invention is concerned with a device to depress the keys of a keyboard, particularly the keys of a musical instrument. More particularly, the device may be used to depress and keep depressed the keys of the keyboard on a pipe organ, especially when the organ is being tuned.

4 Claims, 7 Drawing Figures

REMOTE-CONTROLLED KEY-DEPRESSING DEVICE

BACKGROUND OF THE INVENTION

When tuning instruments having a keyboard, particularly pipe organs, it is necessary to selectively activate the keys while tuning the instrument at a location which is further than arm's reach from the keyboard. In the past, and indeed even to this day, it is common for those who tune pipe organs to employ an assistant to activate the keys on command from the organ tuner, who then tunes the pipes as necessary to adjust for changes in tuning brought about by physical deterioration of the organ or changes in the seasons, which also affect the tuning and necessitate retuning to compensate.

Obviously, in these days of high inflation, the use of an assistant means that the organ tuner must charge for the services of an assistant who merely depresses the keys. If the services of the assistant could be eliminated, then productivity would be increased, the fee for tuning could be reduced, and the tuner could even improve his profit margins.

DESCRIPTION OF THE PRIOR ART

Remote control devices which could depress the keys of a keyboard have been patented, but despite the fact that they were patented many years ago, it is believed they are not used today. The reason for this is that the patented devices were quite complicated and therefore undoubtedly expensive to produce, unwieldy and of limited portability, and probably prone to breakdowns.

For example, U.S. Pat. No. 1,051,156, issued in 1913, describes the problems of conventional tuning and then describes a device for depressing the keys, which is considerably more complex than the light-weight, portable remote controlled keyboard activator of this invention.

U.S. Pat. No. 1,434,568, issued in 1922, completely by-passes the keyboard and relies instead on temporary shunt circuits for energizing the operating magnets of an organ by use of a portable auxiliary keyboard. Obviously, time-consuming electrical connections would be involved for each pipe organ to be tuned.

SUMMARY OF THE INVENTION

It is an object of this invention to provide a portable, lightweight, simply constructed, and simple-to-use device to be used as a remote assistant to activate the selected keys of a keyboard.

It is an object of this invention to provide such a device which may be used as the remote keyboard activator for a pipe organ tuner.

It is another object of the present invention to provide a process utilizing the invention in tuning a pipe organ to thereby provide a more efficient, less costly tuning service to the owners of pipe organs.

Generally, the remote-controlled device of this invention comprises in the device: separate means for depressing each of the desired keys, each of said means being pivotally mounted on a fulcrum, means for selectively rotating the key-depressing means about its fulcrum so that at least a part of each of the key-depressing means depresses the corresponding desired key(s) of the instrument's keyboard, above which the device is positioned. Preferably, the same fulcrum is common to all the means for depressing the keys.

DESCRIPTION OF THE PREFERRED EMBODIMENTS

Figure 1A:
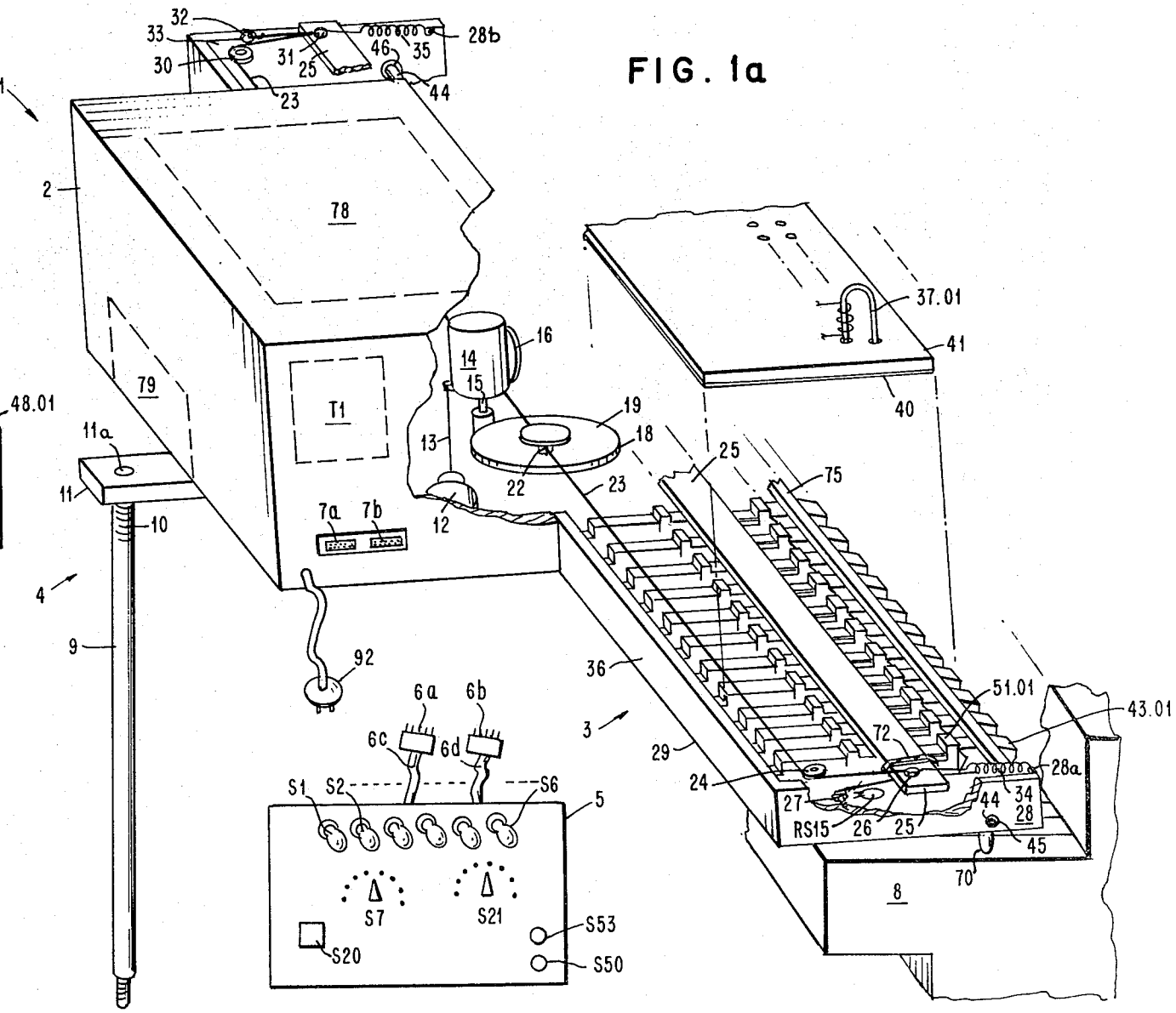
FIG. 1*a* is a partial, exploded, cut-away view of the device of this invention positioned at a keyboard of, e.g., a pipe organ.
Figure 1B:
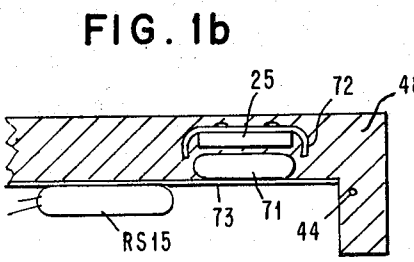
FIG. 1*b* is a partial end view of the mechanism after one end panel (28 of FIG. 1*a*) of the device has been removed.

In FIG. 1*a* the preferred device is indicated as 1, which has three main parts: (a) the actuator case 2 containing the actuating mechanism and circuitry, the position of which circuitry as two circuit boards inside the actuator case 2 is shown as 78 and 79, access to which is through door 76, which is attached to case 2 by hinge 77; (b) the key depressing mechanism 3; and (c) the adjustable leg component 4. It is preferred to have a remote-control unit 5, which may be wired to the unit by means of connector plugs 6*a* and 6*b* on the cables 6*c* and 6*d* from control unit 5 and corresponding connector receptacles 7*a* and 7*b* on actuator case 2. Wireless control may be used instead.

The device is simply set up by positioning it over the keyboard 8 so that the key depressing mechanism 3 is aligned with the keys in such a way that each of the individual key-depressing means is positioned over its corresponding key on the keyboard and leg 70 is on the side frame of the keyboard shown and leg 71 (not shown) is on the other side frame of the keyboard (also not shown). Then leg 9 is adjusted in length so that the device will remain in a suitable position, e.g., at a slight slope down from the keyboard 8 to the leg 9. This is accomplished by turning leg 9 so that its threaded end 10 is screwed into or out of the threaded bushing 11*a* in part 11.

In describing the preferred embodiment, the mechanism will be described first and then its activating circuitry and control circuitry.

The Mechanism

The mechanism is shown in FIGS. 1*a*, 1*b*, 2*a* and 2*b*. In operation, current is supplied to the device by a plug 92 from a standard electrical outlet. The current is then stepped down in voltage by transformer T1 to a suitable voltage of about 12 to about 15 volts and rectified by bridge rectifier BR1. One may instead utilize a storage battery, either of the replaceable or rechargeable kind. In either case, it should be noted that the device operates on low voltage and therefore should not present any hazards to the user or others.

When a signal corresponding to a key desired to be depressed is received from the control unit 5, the circuitry operates to supply current to the solenoid 12 which is activated and pulls connecting link 13. That link 13 is connected at one end to the solenoid 12 and at the other end to the housing of electric motor 14. Motor 14 is rotatably mounted in this configuration so that its shaft 15 is vertically down in its rest position. Motor 14 is free to rotate around the horizontal rotation axis of ball bearing turntable 16, to which the motor 14 is attached. Consequently, when solenoid 12 is activated, solenoid 12 pulls connecting link 13, which in turn pulls electric motor 14, causing it to pivot on the ball bearing turntable 16. This in turn causes the rubber drive bushing 17 on shaft 15 of the motor 14 to make contact with rubber drive tire 18 on drive wheel 19. Drive wheel 19 is in a horizontal plane with its axis in a vertical plane. Below drive wheel 19 is a ball bearing turntable 20, to which drive wheel 19 is attached concentrically so that the drive wheel 19 may be freely rotated. Concentrically mounted on the same axis above the drive wheel 19 is bobbin 21, which has a slot 22 which passes through its diameter. Passing through slot 22 in bobbin 21 is cord 23, which is preferably made of a durable material such as nylon. Cord 23 is so placed that its approximate mid-point is in slot 22 in bobbin 21. One end of the cord 23 is passed around pulley 24, then over the top of activator bar 25, down through hole 26 in one end of activator bar 25, and then back to screw-eye 27 in side 28 of frame 29, where the end is fixed as by tying. The other end of cord 23 is similarly passed around pulley 30, then over the top of activator bar 25, down through another hole 31 in the other end of activator 25, and then back to another screw-eye 32 in the other side 33 of frame 29, where that end of the cord 23 is fixed, as by tying, in such a fashion that the cord 23 has little or no slack. The activator bar 25 is then at its rest position where it is held by tension springs 34 and 35, which are attached to frame 29 at points 28*a* and 28*b* respectively and to the activator bar 25 by hooking their other ends through holes 26 and 31 respectively.

The ends of the cord 23 may be directly connected one to each end of the activator bar 25. In another configuration, the cord 23 can be connected in the same manner except that it will be passed around rollers (pulleys) which are part of the activating bar 25 and then be tied to the machine frame instead of the bar. This will increase the mechanical advantage applied to pull the activator bar 25 against the springs 34 and 35.

The motor 14, when its drive bushing 17 engages the rubber drive tire 18 on drive wheel 19, causes the concentrically mounted bobbin 21 to turn, effectively shortening the remaining length of the cord 23 and causing activator bar 25 to be pulled toward the back 36 of frame 29 and away from springs 34 and 35, causing those springs to be placed under tension.

Figures 2A, 2B:
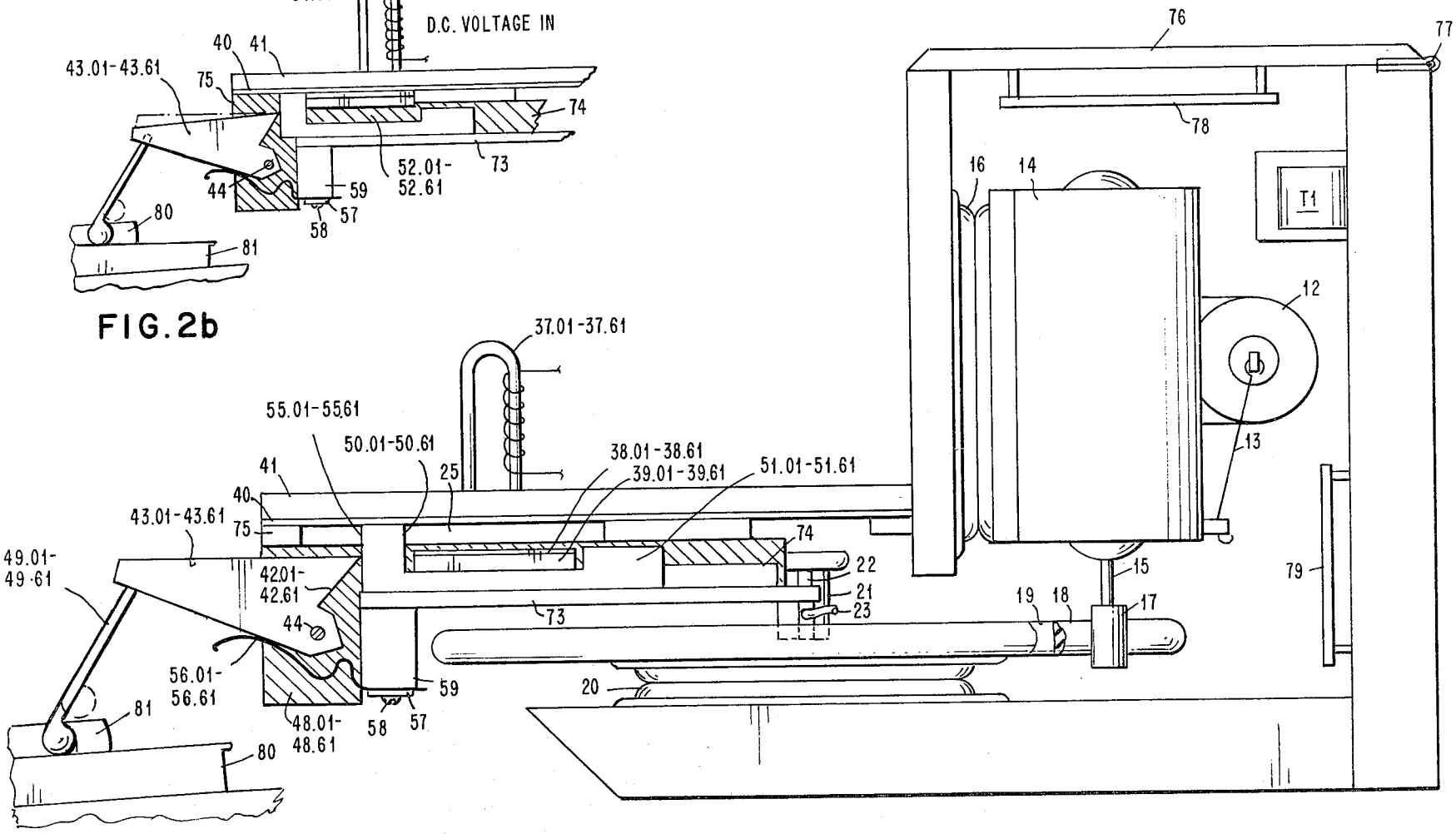
FIG. 2*a* is a partially sectioned elevation view of the device, showing it unactivated.
FIG. 2*b* is a portion of FIG. 2*a* showing the device as it functions, when activated, to depress the keys of a keyboard instrument.

At this point the circuitry has been activated by the note selector switch S7 (on remote-control unit 5) causing those of the 61 electromagnets 37.01 to 37.61 corresponding to the desired key(s) to be activated and causing the attraction of the corresponding ferrous metal strips 38.01 to 38.61 (adhesively attached to the tops of corresponding wooden pushers 39.01 to 39.61) to the bottom of non-ferrous (aluminum) cover plates 40, which are adhesively attached to the bottoms of magnet holders 41, which may be made of wood. The electromagnets 37.01 to 37.61 are affixed with adhesive in holes in magnet holders 41 so that the ends of the magnets are close to or touching cover plates 40. With current still supplied to those of the electromagnets 37.01 to 37.61 which correspond to the desired keys of the instrument which are to be depressed, current is removed from motor 14 and solenoid 12. Then, springs 34 and 35, which are under tension, cause the activator bar 25 to return to its rest position with springs 34 and 35 under little or no tension. In the process of returning, the cord 23 on bobbin 21 unwinds and the activator bar 25 moves all of those pushers 39.01 to 39.61 which are attracted to electromagnets 37.01 to 37.61. As those of pushers 39.01 to 39.61 are moved forward, they push against the corresponding inside fronts 50.01 to 50.61 of sleds 51.01 to 51.61, which slide on part 73 and have forward travel limited by part 75. Then outside fronts 55.01 to 55.61 of sleds 51.01 to 51.61 push against edges 42.01 to 42.61 of levers 43.01 to 43.61 causing the levers 43.01 to 43.61 to rotate about rod 44, which is secured at either end of holes 45 and 46 respectively of side members 28 and 33 of frame 29 and which rod 44 also passes through each lever 43.01 to 43.61 and each spacing member 48.01 to 48.62 between adjacent levers 43.01 to 43.61 and outside of terminal levers 43.01 and 43.61 and locates each lever in relation to its neighboring lever(s) 43.01 to 43.61. When the selected levers 43.01 to 43.61 are rotated by the pushers 39.01 to 39.61, the corresponding depressants 49.01 to 49.61 on those levers 43.01 to 43.61 are moved downward against the key(s) above which they are located. In FIGS. 2*a* and 2*b*, the depressants 49.01 to 49.61 for white keys 80 are shown in the solid line and are longer than those of depressants 49.01 to 49.61 which are used to depress the black keys 81 and which are indicated by the dotted line. When located above the keyboard of a pipe organ, the action of the depressants 49.01 to 49.61 causes the desired note(s) to be sounded and maintained without the continued application of power from the device.

To reset the device, the motor switch S 53 is manually activated and the circuit causes current to be delivered to the motor 14 and solenoid 12. The process described above is repeated except that the electromagnets 37.01 to 37.61 are not activated as activator bar 25 is pulled back activating RS 15 and allowing the selected pushers 39.01 to 39.61 to fall back into cavities 52.01 to 52.61 in sleds 51.01 to 51.61 by force of gravity. Levers 43.01 to 43.61 are returned to their rest position by spring urging supplied by leaf springs 56.01 to 56.61 made from spring bronze sheet. All the leaf springs 56.01 to 56.61 are attached to front 59 by strip 57 and screws 58. As levers 43.01 to 43.61 return to their rest position, they push sleds 51.01 to 51.61 back to their original position, the sleds' travel being limited by stops 74.

At that stage the device is at rest stage and may either be turned off or have its switches activated for the same or other keys to be depressed. However, one need not separately reset the device of this invention in order to change the selected note. One can activate the device for one note after another.

Circuitry

Figure 3A:
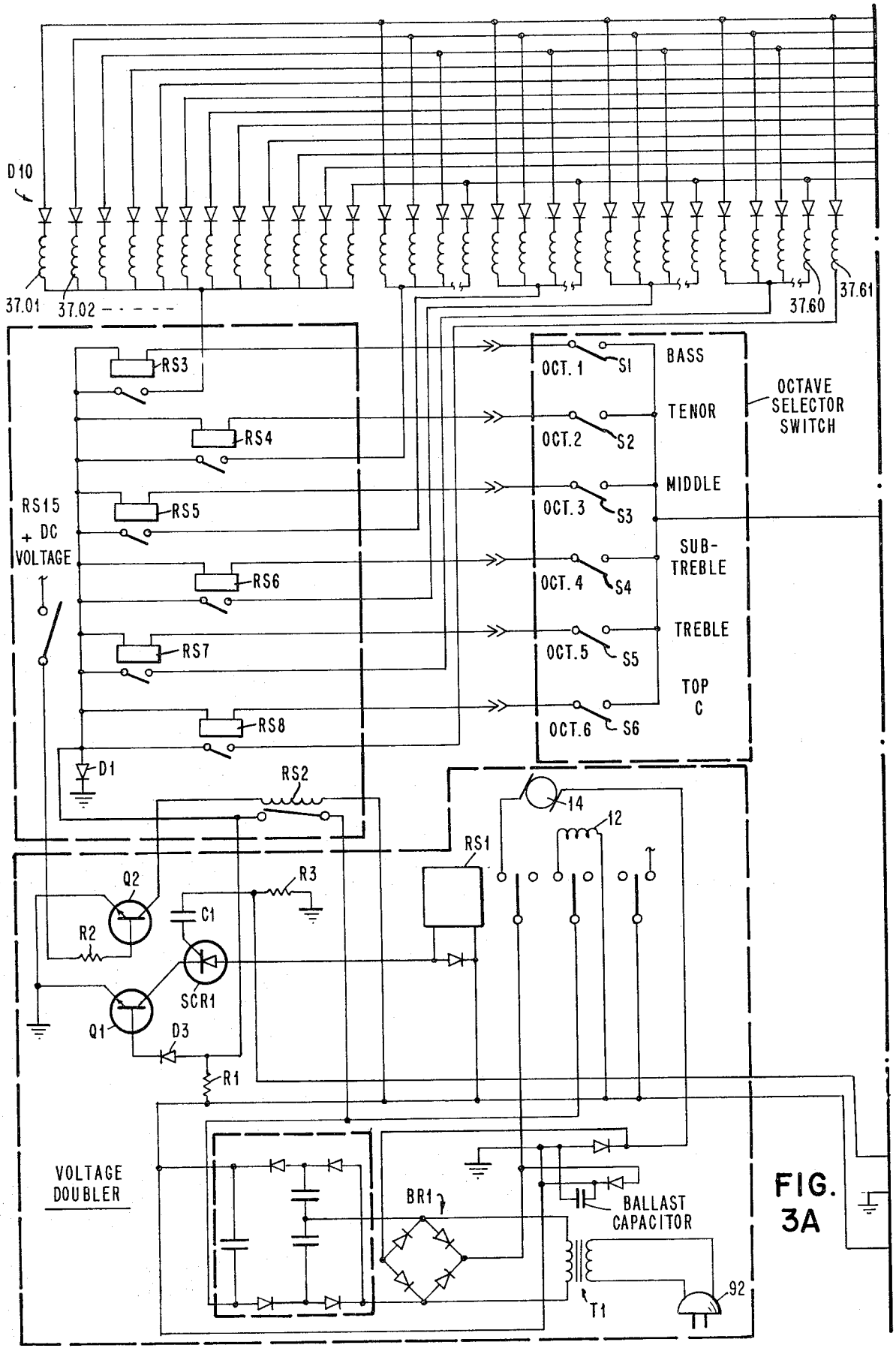
FIG. 3*a* and FIG. 3*b* together are a schematic diagram showing the actuating circuit and the remote-control circuitry.
Figure 3B:
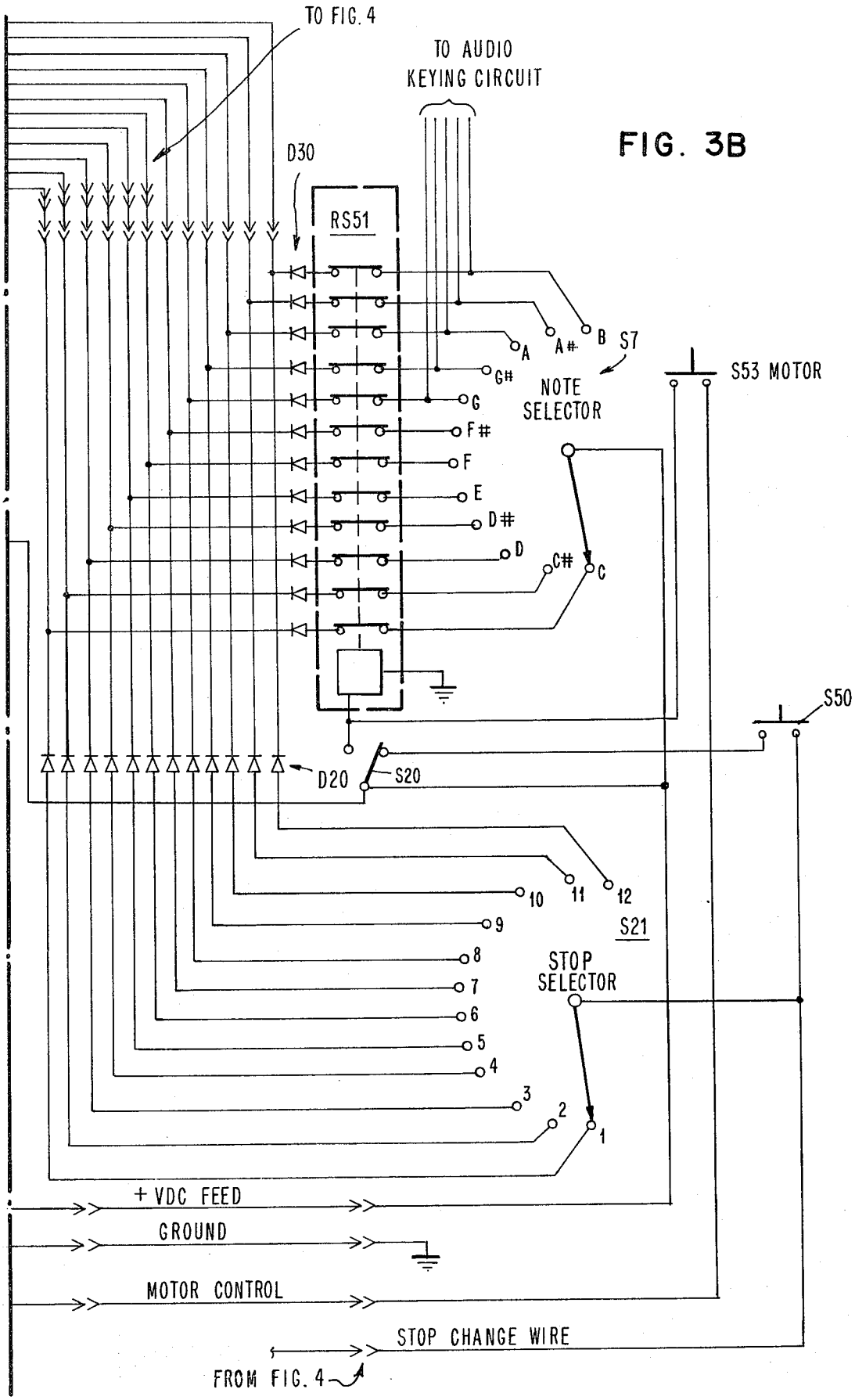
Figure 4:
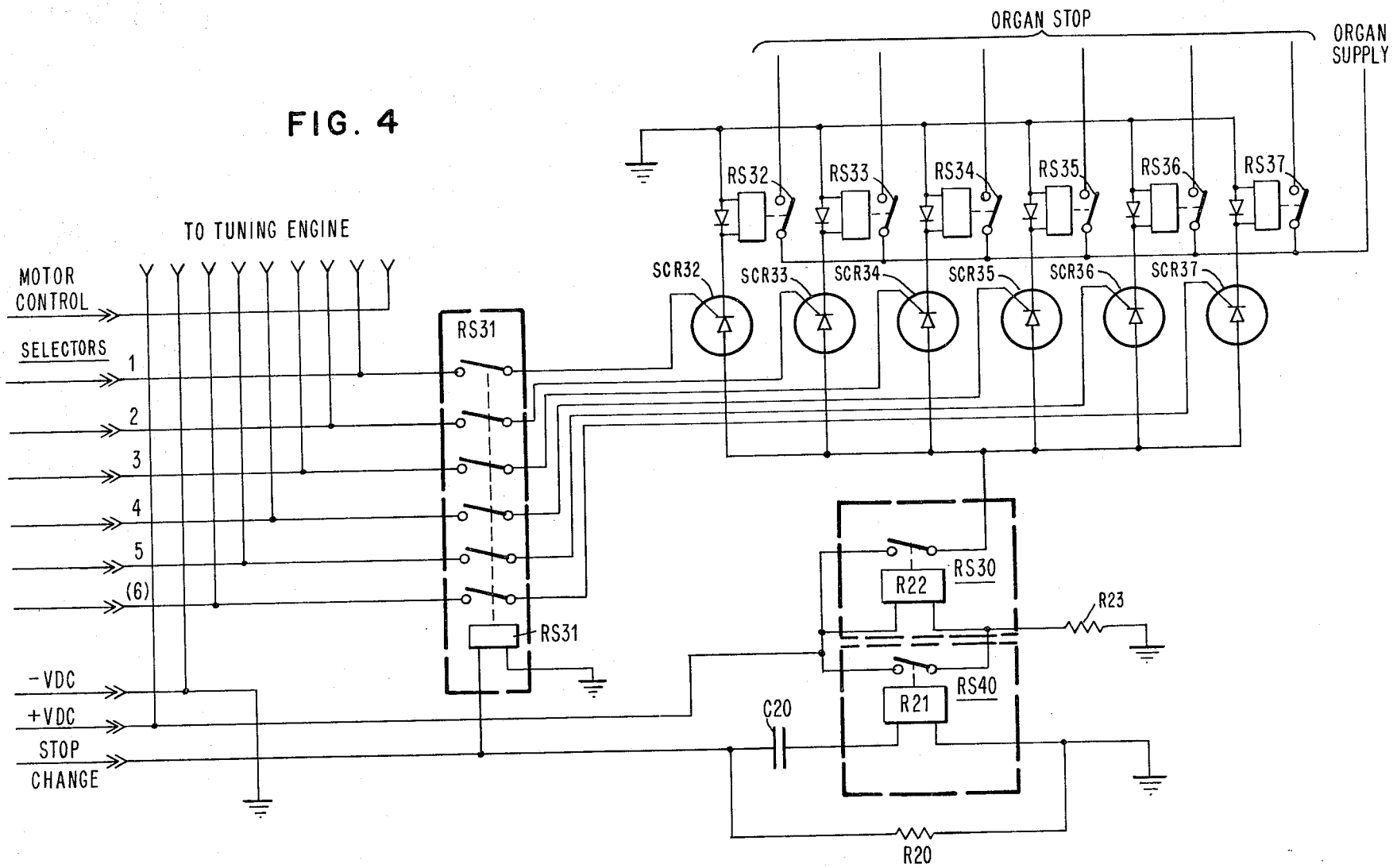
FIG. 4 is a schematic diagram showing the stop action controller.

The circuitry is shown in FIGS. 3*a*, 3*b* and 4. FIGS. 3*a* and 3*b* show the circuitry for the mechanism of the device of this invention and the remote control unit to control the device. FIG. 4 shows the circuitry for the stop action controller to be used for the control of the stops on a pipe organ.

The functioning of the mechanism has been generally described under the preceding section. To use the device after it has been positioned over the keyboard, one connects the remote-control unit 5 to the circuitry of the mechanism by plugging connectors 6*a* and 6*b* into receptacles 7*a* and 7*b* respectively on the side of actuator case 2. Then one operates the device by manipulating the switches on the remote-control unit 5. One chooses the desired octave by closing one of the octave switches S1 to S6. The desired note may be chosen by using the note selector switch S7, making sure that switch S20 is in the note-selection position. Before choosing a stop one must make sure that switch S20 is in the stop-selection position. The stop is chosen by means of stop-selector switch S21.

When the machine is signalled by a current at the gate of SCR 1 via capacitor C1, the circuitry of the schematic shown in FIGS. 3*a* and 3*b* will cause the activator bar 25 to travel to its maximum distance from the springs 34 and 35 and return to its rest position. (Its rest position is the position at which the force exerted by the springs no longer causes it to travel toward the springs for whatever reason). This function and the maximum distance which the activator bar 25 can travel away from the springs 34 and 35 is preset by the circuitry of FIGS. 3*a* and 3*b*, specifically the sensor switch RS 15. As may be seen in FIG. 1*b*, the switch RS 15 senses the position of the activator bar 25 when claw 72 attached to activating bar 25 drags permanent magnet 71 along part 73 over the switch RS 15. Switch RS 15 is set so that the activator bar 25 will travel far enough that it will no longer be between the pushers 39.01 to 39.61 and the magnet cover 40.

The circuitry shown in FIGS. 3*a* and 3*b* functions in the following manner:

The signal to the gate of SCR 1 via capacitor C1 (which is connected to ground via resistor R3) causes SCR 1 to conduct. Current is supplied to SCR 1 by transistor Q1. This current, when conducted by SCR 1 causes relay RS 1 to close in its active mode. Relay RS 1 can be any suitable normally open double throw relay. In the closed position, one set of contacts supplies a motor 14 and one set a solenoid 12 which pulls the friction drive bushing 17 of motor 14 into contact with friction drive tire 18 on drive wheel 19. This contact causes the motor 14 to drive the drive tire 18, rotating the drive wheel 19. As the drive wheel 19 rotates, the cord 23 will be wound on the bobbin 21. This will cause the cord 23 to pull the activator bar 25 back and load the springs 34 and 35. The reed switch sensor RS 15 will sense the position of the activator bar 25 when it has reached the desired point of travel away from the springs 34 and 35 and will apply current to the base of transistor Q2. Transistor Q2 will thus be caused to conduct current and apply it to the coil of relay RS 2. Relay RS 2 is a normally open single throw relay. Its contacts will close and conduct current. Part of this current will be applied to the base of transistor Q 1. This will reverse-bias the diode D 3 and cause the transistor Q 1 to become non-conducting. Thus transistor Q 1 will no longer supply current to relay RS 1 via SCR 1, and the relay RS 1 will assume its rest position and the contacts will open. Thus the motor shaft 15 will cease to rotate and the solenoid 12 will cease to pull the drive bushing 17 against the drive tire 18 so that the drive tire 18 will no longer be driven and the drive wheel 19 will be free to rotate in response to any force which is applied. The springs 34 and 35 pull the activating bar 25 forward and cause the drive wheel 19 to rotate as the cord 23 unwinds from the bobbin 21. The sensor RS 15 will cease to supply current to the base of transistor Q 2. Transistor Q 2 will cease to conduct current to relay RS 2 which, in turn, will cease to conduct current to the base of transistor Q 1. Current will then be applied to the base of transistor Q 1 via resistor R 1, and the transistor will become conductive, but no current will reach the coil of relay RS 1 since SCR 1 is now non-conducting.

Electromagnets 37.01 to 37.61 are seen on FIG. 3*a* and are connected to the control unit 5 through diodes D 10. If one of the electromagnets 37.01 to 37.61 also seen on top of the machine in FIGS. 1*a*, 2*a* and 2*b*, has been activated (by closing its corresponding contact at the note selection switch S 7 and the corresponding contact for its octave at one of the octave selection switches S1 to S6, it will most likely pick up its corresponding pushers 39.01 to 39.61 when the activating bar 25 reaches the point in its backward travel at which it is no longer between pushers 39.01 to 39.61 and the electromagnets 37.01 to 37.61. When the sensor RS 15 senses the position of the bar and saturates transistor Q 2 into conducting and causes relay RS 2 to close, the current provided by this relay, which cuts off transistors Q 1, will provide a high voltage to the feed for relays RS 3 to 8, which are the octave selection relays. This is because the contacts feed for relay RS 2 is from the higher voltage circuitry. (Note: differentiating voltage levels in this schematic are achieved in the negative sides of the power supplies; i.e., there are different ground levels. The positive sides of the two power supplies may be common.) This high voltage application will ensure that the inertia of the pushers 39.01 to 39.61 is overcome and that the selected pushers 39.01 to 39.61 will be made, by the electromagnets 37.01 to 37.61, to rise to contact the bottom of the magnet cover 40. As the activating bar 25 comes forward, as described previously, it will move a pusher of 39.01 to 39.61 forward along the underside of the magnet cover 40 until it contacts the inside front wall 50.01 to 50.61 (the upward protrusion) of the sleds 51.01 to 51.61. At this point, although the electromagnets 37.01 to 37.61 are allowed to remain activated, it is not necessary to do so because the pushers 39.01 to 39.61 will be held in this position due to their being wedged between the inside sled front wall 50.01 to 50.61 and the activating bar 25. It is a matter of choice to leave the electromagnets 37.01 to 37.61 active. The sleds 51.01 to 51.61 will move forward, as forced by the activating bar 25 via the pushers 39.01 to 39.61, and will contact the edges 42.01 to 42.61 of the levers 43.01 to 43.61. The force thus applied to the levers 43.01 to 43.61 will cause them to rotate around the axle rod 44 (levers 43.01 to 43.61 are mounted on a common axle 44 which may be made of one or more individual wires).

The depressants 49.01 to 49.61 which protrude downward from the levers 44.01 to 44.61 will be positioned over the appropriate keys of the instrument which is being tuned. As the selected lever(s) 43.01 to 43.61 rotates, the corresponding depressants 49.01 to 49.61 will descend until the key stops the action or some preset point of travel in the machine mechanism is reached, i.e., the rest position of the activating bar 25, as described above.

As the activating bar 25 moves forward and the sensor RS 15 allows relay RS 1 to open through its control of transistor Q 2, the high voltage which was applied previously to the feed for the octave selection relays is removed and a lower voltage is then supplied via diode D 1. This current will maintain the elevated position of the pushers 39.01 to 39.61 without overheating the magnet during a prolonged application of current. Diode D 1 prevents entry of the higher voltage to the lower voltage system during the application of the high voltage to the contacts feed of the octave selection relays RS 3 to RS 8.

STOP ACTION CONTROL

The stop action control is generally shown in FIG. 4. Since the stop action is to be controlled through wires which are also used to control the device of this invention (referred to as the "Tuning Engine"), it will be necessary for the stop controller to hold its position while the device of this invention is used. For this reason provision must be made to interrupt the cable connections to the stop controller. This operation is performed by the gang switch (RS 31), one contact set of which exists for each selection wire (SEL 1–5 or more) which enters the stop controller. It is also necessary that the relay which controls the organ circuitry be able to maintain its operation without change in the absence of the signal which caused it to operate. A SCR or a similar device is appropriate for this purpose when used with direct current.

Selection of the desired stop is made with the stop selector switch S 21. The control unit 5's switch S 20 is turned to the stop control position. This will keep the motor circuit in the tuning engine from being activated. The stop selector switch S 21 will select the stop control SCR gate which will receive current when the change is to be made. Unlike note selection in the tuning engine, no current is present in the selector wire, or in the selector switch, prior to the actual change. (This is so even though current is present in the tuning engine electromagnets 37.01 to 37.61, but need not be present, during *stop* changes). If it were present, the new stop would come on at once, and the stop already functioning but not now selected would not cease to function. This would be a distraction. As current must cease to flow through an SCR for a certain, although small (mechanically insignificant) period of time for it to become non-conductive, provision is made for this to happen simultaneously with the presentment of the selector signal to the next desired SCR gate.

When the stop change button S 50 is depressed, current of positive polarity will be sent through whichever selector wire has been selected and through the stop change wire. This transmission will be simultaneous in its onset and removal. Thus current will be present at whichever set of contacts in the controller gang switch RS 31 is contained in the circuit for the chosen stop control. When the current in the stop change wire flows through the gang switch coil, all of the gang switch contact sets will close and current will flow from the active selector wire and reach its corresponding SCR gate through its respective resistor, if included at each such SCR gate. At the same time, current will flow through capacitor C 20 to the extent of its capacitance. This flow of current will take a specific period of time and during this time current will also flow through the coil R 21 of relay RS 40. The time constant of the RC circuit which consists of the relay coil resistance and the value of the capacitor must be such that the relay contacts will have closed securely prior to the cessation of current flow through the capacitor C 20. When the capacitor C 20 is fully charged, current flow across its plates will cease and the contacts of relay RS 40 will open again. The contacts of relay RS 40, when closed, will short relay coil R 22 of relay RS 30 from its circuit. (RS 30 is connected to ground through resistor R 23.) Current will cease to flow through this coil as long as the contacts of relay RS 40 remain closed, which is for the time permitted by the capacitor value and the resistance value of the coil R 21 for relay RS 40. When the capacitor C 20 has been charged and current ceases to flow through the coil R 21 of relay RS 40 and the contacts of relay RS 40 have opened, the coil R 22 of relay RS 30 will be admitted to its circuit once again and current will once again flow through the coil R 22 of relay RS 30. This whole operation will cause the contacts of relay RS 30 to open for a pre-determined period of time and close again all in response to the presentment of the current in the stop change wire. As the contacts of relay RS 30 supply the SCRs (SCR 32 to SCR 37) with their current, they will become non-conducting when these contacts open. Only the SCR which has a current at its gate will be rendered conducting when current is supplied to the SCRs once again upon the closing of the contacts of relay RS 30. As long as the duration of the current applied to the stop change wire, and thus the stop selection wire as chosen, exceeds the time period of the opening and closing of the contacts of relay RS 30, the contacts of the gang switch RS 31 will remain closed and current will be present at the set of contacts in gang switch RS 31 which control the selected SCR gate. This SCR will conduct when the contacts of relay RS 30 close and will cause the contacts of the relay (RS 32 to 37) to which it is connected to close. The contacts of relays RS 32–37 are not connected to circuits within the machine power supply in this schematic but take their power from the organ power supply and directly control the organ's stop action solenoids. It would also be possible to have the machine power supply made common with the organ power supply either on its positive side or negative side.

When the current is no longer supplied to the stop change wire, the gang switch RS 31 contacts will open. As long as they remain so, no current can be presented to an SCR gate. As only the stop change wire will close the contacts of this switch, the tuning engine can change notes through the use of the same selection wires, and activation of its motor 14 is possible without affecting the stop controller. When current is no longer present in the stop change wire the capacitor C 20 will charge to the opposite polarity via resistor R 20. If resistor R 20 is of a high enough value that insufficient current flows through the circuit represented by R 20, C 20, to supply relay coil R 21 (RS 40) with enough current to close its contacts, then no second interruption of supply to the SCRs will occur, as is desired.

Remote-Control Unit

The circuitry for the remote-control unit 5 is generally shown in FIGS. 3*a* and 3*b*. Every component of the system operates from the remote-control unit 5. Separate selector switches are provided for note selection S 7 and stop selection S 21. Stop-selector switch S 21 is connected via diodes D 20 to the selector wires common to the note selection and stop selection. This is necessary so that the reference pitches will continue to sound while stops are being changed. Switch S 20 represents the mode selector. In one position it sets the control box to control note changes and, in the other, to control stop changes. Transmission of the current through the proper selector wire during stop changes is not to precede but be concurrent with transmission of the stop change signal through the stop change wire. This is achieved by feeding stop selector switch S 21 with current, of positive polarity, from the contacts of S 50 which also sends, directly, the signal through the stop change wire. With mode selector switch S 20 in the position shown, the control unit 5 will control note changes. Note selector switch S 7 is always fed current; even when the mode selector switch S 20 is in the position to control stop changes. This is necessary so that the reference pitch will continue to sound. Gang switch RS 51 will not be closed in this position, however, so the position of the note selector switch S 7 will have no effect outside of the control unit 5 itself.

If switch mode selector S 20 is set for note change, gang switch RS 51 will close at once. It is the function of gang switch RS 51 to allow note selector switch S 7 to be fed continuously but not to transmit during stop changes. Gang switch RS 51 is connected via diodes D 30 to the selector wires to the electromagnets 37.01 to 37.61.

The point on the schematic which is marked "to audio keying circuit" shows only five of the twelve wires which would go to this circuit. One of the twelve wires would be connected to each of the note selection contacts. The wires continue beyond the point shown in the schematic and each causes the selection of a note which corresponds by note name (C, C#, etc.), and not necessarily frequency, to the note which corresponds to the contact set in the selector switch to which the wire is connected. It would also be possible to use the combination of twelve note selector switch output wires and the six octave selector wires to control the outputs of additional frequency dividers to produce 61 reference pitches.

The reference pitches are audible pitches to which the organ will be tuned. Since an organ will more likely than not be flat of "concert pitch" (if "concert pitch" is A 440 Hz. then the other eleven pitches of the octave will be tuned relative to A with temperament) and, possibly, sharp of concert pitch, provision will be made to increase or decrease the frequency of all notes in proportion to each other so that the resulting reference pitches will be as flat or sharp as the organ but still be tempered.

S 53 is provided to send a positive current to the motor SCR, SCR 1, upon closing of motor switch S 53 when the mode selector switch S 20 is in the position to control note changes.

It will be apparent to those skilled in the art that modifications and changes in the components and specifications above may be made without departing from the scope of the invention.

What is claimed is:

1. A remote-controlled device for depressing the keys of a keyboard instrument which comprises in the device (a) separate means for depressing each of the desired keys, each of said means being pivotally mounted on a fulcrum, (b) electromagnetic means for selecting each means for depressing desired keys which comprises (i) an electromagnet and (ii) a pusher, which is capable of being magnetically attracted to said electromagnet when manually selectable switching means in the device applies current to the electromagnet thereby selected, which corresponds to the desired key of the instrument, (c) an activator means normally spring-urged toward the separate means for depressing each of the desired keys, and (d) means whereby the activator may be moved in opposition to its spring; so that in operation the activator is moved in opposition to its spring, current is applied to said electromagnet selected, causing the corresponding pusher to be attracted to the electromagnet and in line between the activator and the means for depressing the desired keys and then allowing the spring to urge the activator, causing the activator to move the pusher against the means for depressing the desired key, thereby causing the means for depressing the desired key to rotate on the fulcrum and depress the desired key.

2. A device as claimed in claim 1, wherein the same fulcrum is common to all of the separate means for depressing the keys.

3. A device as claimed in claim 2 wherein the fulcrum is a continuous rod.

4. A device as claimed in claim 1 wherein the separate means for depressing the keys are spring-urged away from the keys.

* * * * *